US010384472B2

(12) United States Patent
Onodera et al.

(10) Patent No.: US 10,384,472 B2
(45) Date of Patent: Aug. 20, 2019

(54) DRYING DEVICE AND PRINTING APPARATUS

(71) Applicants: Ken Onodera, Kanagawa (JP); Sho Sawahata, Tokyo (JP); Junji Nakai, Kanagawa (JP); Toshihiro Yoshinuma, Kanagawa (JP); Yasuhisa Katoh, Kanagawa (JP); Hirokazu Ikenoue, Tokyo (JP); Satoshi Kitaoka, Kanagawa (JP); Hideaki Nishimura, Kanagawa (JP)

(72) Inventors: Ken Onodera, Kanagawa (JP); Sho Sawahata, Tokyo (JP); Junji Nakai, Kanagawa (JP); Toshihiro Yoshinuma, Kanagawa (JP); Yasuhisa Katoh, Kanagawa (JP); Hirokazu Ikenoue, Tokyo (JP); Satoshi Kitaoka, Kanagawa (JP); Hideaki Nishimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/462,449

(22) Filed: Mar. 17, 2017

(65) Prior Publication Data

US 2017/0266991 A1 Sep. 21, 2017

(30) Foreign Application Priority Data

Mar. 18, 2016 (JP) ..... 2016-056122
Oct. 17, 2016 (JP) ..... 2016-203938
Feb. 3, 2017 (JP) ..... 2017-019064

(51) Int. Cl.
*B41J 11/02* (2006.01)
*B41J 11/00* (2006.01)

(52) U.S. Cl.
CPC ..... *B41J 11/002* (2013.01)

(58) Field of Classification Search
None
See application file for complete search history.

(56) References Cited

U.S. PATENT DOCUMENTS 9,605,900 B2 3/2017 Boland et al.
2005/0195271 A1* 9/2005 Denawa ..... G03D 13/002 347/228

(Continued)

FOREIGN PATENT DOCUMENTS

JP 4-144748 5/1992
JP 5-297557 11/1993

(Continued)

*Primary Examiner* — Erica S Lin
(74) *Attorney, Agent, or Firm* — Oblon, McClelland, Maier & Neustadt, L.L.P.

(57) ABSTRACT

A drying device includes a contact heater unit to contact and heat a medium. The contact heater unit includes a plurality of heating members each having a curved contact face to contact the medium among plural heating members of the plurality of heating members to contact a first surface of the medium opposite a second surface of the medium on which liquid is applied. The plurality of heating members includes a first heating member and a plurality of second heating members. The first heating member has a maximum contact distance to contact the medium. The plurality of second heating members is disposed upstream from the first heating member in a direction of conveyance of the medium. Two heating members of the plurality of second heating members immediately upstream from the first heating member in the direction of conveyance of the medium contact the first surface of the medium.

20 Claims, 10 Drawing Sheets

(56) References Cited

U.S. PATENT DOCUMENTS

| | | | | |
|---|---|---|---|---|
| 2014/0232797 | A1 | 8/2014 | Onodera et al. | |
| 2014/0253631 | A1* | 9/2014 | Namba ..... | C09D 11/54 347/21 |
| 2015/0174921 | A1 | 6/2015 | Onodera et al. | |
| 2016/0101635 | A1 | 4/2016 | Hoshino et al. | |
| 2016/0263914 | A1 | 9/2016 | Hoshino | |
| 2016/0273832 | A1 | 9/2016 | Asada et al. | |

FOREIGN PATENT DOCUMENTS

| | | |
|---|---|---|
| JP | 2000-019877 | 1/2000 |
| JP | 2007-187821 | 7/2007 |
| JP | 2010-036589 | 2/2010 |
| JP | 2010-204235 | 9/2010 |
| JP | 2013-028022 A | 2/2013 |
| JP | 2013-039721 | 2/2013 |
| JP | 2014-152964 | 8/2014 |
| JP | 2016-107519 | 6/2016 |

* cited by examiner

DRYING DEVICE AND PRINTING APPARATUS

CROSS-REFERENCE TO RELATED APPLICATIONS

This patent application is based on and claims priority pursuant to 35 U.S.C. § 119(a) to Japanese Patent Application Nos. 2016-056122, filed on Mar. 18, 2016, 2016-203938, filed on Oct. 17, 2016, and 2017-019064, filed on Feb. 3, 2017, in the Japan Patent Office, the entire disclosure of which each of is hereby incorporated by reference herein.

BACKGROUND

Technical Field

Embodiments of the present disclosure relate to a drying device and a printing apparatus.

Related Art

As a printing apparatus to apply liquid onto a continuous sheet or the like to perform printing, for example, a printing apparatus is known to accelerate drying of the applied liquid to reduce the cockling (corrugation due to swelling) of the continuous sheet or the like.

SUMMARY

In an aspect of the present disclosure, there is provided a drying device that includes a contact heater unit to contact and heat a medium. The contact heater unit includes a plurality of heating members each having a curved contact face to contact the medium. The plurality of heating members includes a first heating member and a plurality of second heating members. The first heating member has a maximum contact distance to contact the medium among plural heating members of the plurality of heating members to contact a first surface of the medium opposite a second surface of the medium on which liquid is applied. The plurality of second heating members is disposed upstream from the first heating member in a direction of conveyance of the medium. Two heating members of the plurality of second heating members immediately upstream from the first heating member in the direction of conveyance of the medium contact the first surface of the medium.

In another aspect of the present disclosure, there is provided a printing apparatus that includes a liquid applicator to apply liquid onto the medium and the drying device to dry the medium on which the liquid is applied.

In still another aspect of the present disclosure, there is provided a printing apparatus that includes a first liquid applicator, a first drying device, a second liquid applicator, and a second drying device. The first liquid applicator applies liquid onto a first surface of a medium. The first drying device is constituted of the drying device. The first drying device is disposed downstream from the first liquid applicator in the direction of conveyance of the medium. The second liquid applicator applies liquid onto the second surface of the medium, which is opposite to the first surface of the medium. The second liquid applicator is disposed downstream from the first drying device in the direction of conveyance of the medium. The second drying device is constituted of the drying device. The second drying device is disposed downstream from the second liquid applicator in the direction of conveyance of the medium.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
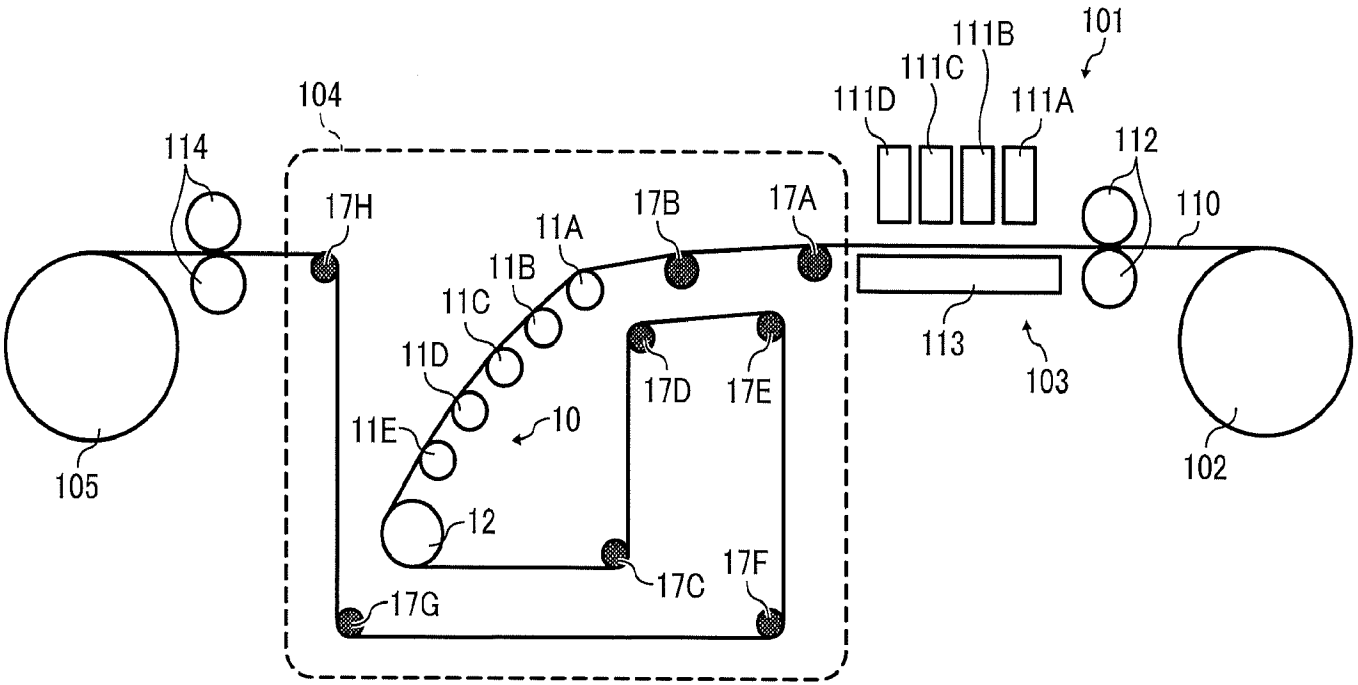
FIG. 1 is a schematic view of a printing apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, wherein like reference numerals designate identical or corresponding parts throughout the several views, embodiments of the present disclosure are described below. First, a printing apparatus according to a first embodiment of the present disclosure will be described with reference to FIG. 1. FIG. 1 is a schematic view of the printing apparatus according to the first embodiment.

The printing apparatus is an inkjet recording apparatus, and includes a liquid application unit 101 including a liquid discharge head, which is a liquid applicator, to discharge and apply ink, which is a color liquid, onto a continuous sheet 110, which is a medium (or member) to be conveyed.

In the liquid application unit 101, for example, full-line heads 111A, 111B, 111C, and 111D of four colors are disposed in this order from the upstream side in a conveyance direction of the continuous sheet 110. The heads 111A, 111B, 111C, and 111D respectively applies liquids of black (K), cyan (C), magenta (M), and yellow (Y) onto the continuous sheet 110. The types and the number of colors are not limited to these types and numbers. Note that the number and types of color are not limited to the above-described four colors of K, C, M, and Y and may be any other suitable number and types.

The continuous sheet 110 is fed from a feeding roller 102, is sent onto a conveyance guide 113, which is disposed to face the liquid application unit 101, by conveyance rollers 112 of a conveyance unit 103 and is conveyed (moved) by being guided by the conveyance guide 113.

The continuous sheet 110 onto which the liquid is applied by the liquid application unit 101 passes a drying device 104 as the drying device according to the present embodiment, and is sent by ejection rollers 114 via rollers 115 and 116 and wound around a winding roller 105.

Figure 2:
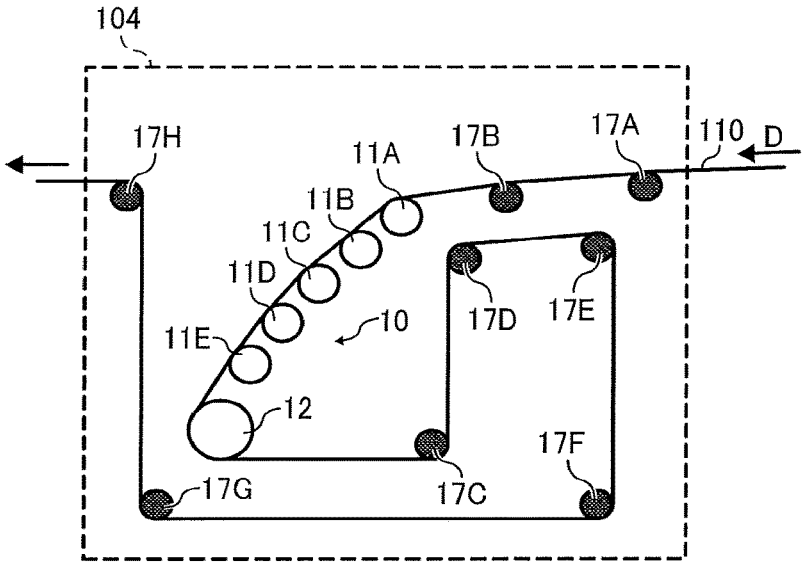
FIG. 2 is an enlarged view of a portion of a drying device of the first embodiment.
Figure 3A:
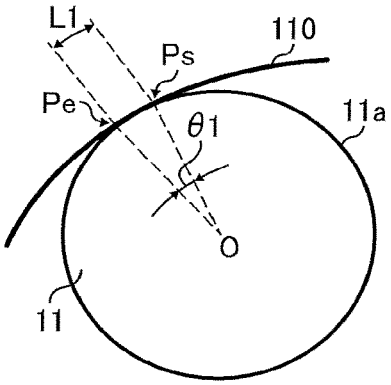
FIGS. 3A and 3B are illustrations of a winding angle with respect to a heating roller and a heating drum.
Figure 3B:
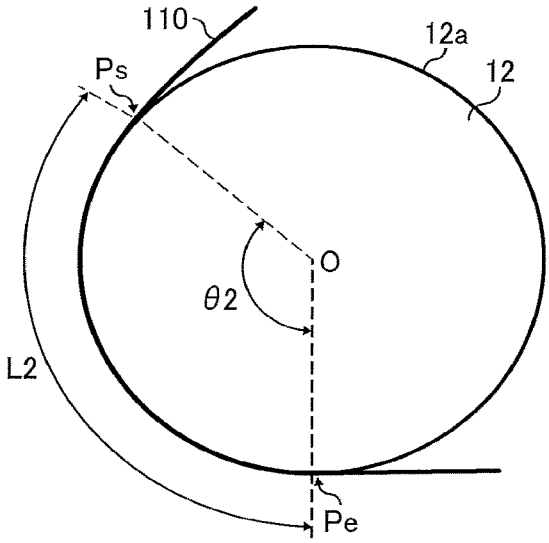

Next, the drying device according to the first embodiment will be described with reference to FIGS. 2, 3A, and 3B. FIG. 2 is an enlarged view of a portion of the drying device. FIGS. 3A and 3B are illustrations of a winding angle with respect to a heating roller and a heating drum.

The drying device 104 includes a contact heater unit 10 to heat the continuous sheet 110 in contact with a surface of the continuous sheet 110 on a side opposite to a surface onto which the liquid is applied. The drying device 104 includes guide rollers 17A and 17B to guide the continuous sheet 110 to the contact heater unit 10, and guide rollers 17C to 17I to guide the continuous sheet 110 that passes through the contact heater unit 10.

The contact heater unit 10 includes heating rollers 11A to 11E, which are a plurality of heating members, including a curved contact face 11*a* to contact the continuous sheet 110, and a heating drum 12 including a curved contact face 12*a* to also contact the continuous sheet 110.

Here, the heating drum 12 is a first heating member (a downstream heating member) as a heating member having a maximum contact distance, among heating members to contact the surface of the continuous sheet 110, which is the medium to be conveyed, on a side opposite to a liquid applied surface of the continuous sheet 110. The heating rollers 11A to 11E are second heating members (upstream heating members) as a heating member disposed upstream from the first heating member in the conveyance direction of the continuous sheet 110 indicated by arrow D in FIG. 2, among the heating members to contact the surface of the continuous sheet 110, which is the medium to be conveyed, on the side opposite to the liquid applied surface.

The heating rollers 11A to 11E may have different diameters. In the present embodiment, all of the heating rollers 11A to 11E and the heating drum 12 are rollers.

A plurality of heating rollers 11A to 11E (hereinafter, referred to as a "heating roller 11" unless distinguished) and the heating drum 12 are disposed in an arcuate arrangement along the conveyance direction D of the continuous sheet 110.

As illustrated in FIGS. 3A and 3B, a conveyance path is configured such that a contact distance L2 between the contact face 12*a* of the heating drum 12 and the continuous sheet 110 is longer than a contact distance L1 between the contact face 11*a* of each of the heating rollers 11A to 11E and the continuous sheet 110. The "contact distance" is a distance in which the continuous sheet 110 contacts a circumferential surface of the heating drum 12 and the heating roller 11 in a direction along a circumferential direction of the heating drum 12 and the heating roller 11 (the conveyance direction D). When a heating member is a curved member (a curved heating member 21 described below) including a curved surface as a contact face, the contact distance is a distance in which the continuous sheet 110 contacts the curved surface in a direction along a circumferential direction of the curved surface (the conveyance direction D).

Here, a winding angle θ2 of the continuous sheet 110 with respect to the contact face 12*a* of the heating drum 12 is greater than a winding angle θ1 of the continuous sheet 110 with respect to the contact face 11*a* of the heating roller 11 (θ2>θ1).

As illustrated in FIGS. 3A and 3B, the winding angles θ2 and θ1 (collectively referred to as a "winding angle θ") indicate angles of a point Ps at which the contact of the continuous sheet 110 with the contact faces 12*a* and 11*a* starts and a point Pe at which the contact of the continuous sheet 110 with the contact faces 12*a* and 11*a* ends, with respect to a center O.

Therefore, in a case where winding angle θ increases, the contact distance also increases insofar as rotary bodies have the same diameter, and even in a case where the winding angles θ are identical to each other, the contact distance increases as the diameter of the rotary body increases.

In the present embodiment, the diameter of the heating drum 12 is greater than the diameter of the heating roller 11, and the winding angle θ2 is greater than the winding angle θ1, and thus, in any case, the contact distance L2 between the contact face 12*a* of the heating drum 12 and the continuous sheet 110 is longer than the contact distance L1 between the contact face 11*a* of the heating roller 11 and the continuous sheet 110.

As described above, even in a case where the winding angles θ are identical to each other, the contact distance increases as the diameter of the rotary body increases. Therefore, by setting the heating drum 12 and the heating roller 11 to have the same diameter, and the winding angle θ2 to be greater than the winding angle θ1, the contact distance L2 between the contact face 12*a* of the heating drum 12 and the continuous sheet 110 is longer than the contact distance L1 between the contact face 11*a* of the heating roller 11 and the continuous sheet 110.

Such a configuration can reduce cockling and improve a drying efficiency.

That is, the strength of the continuous sheet 110 decreases in a state where a time does not elapse from the liquid application, and thus, it may be difficult to bring the continuous sheet 110 on a rear surface side closely into contact with a circumferential surface (a contact face) of the rotary body in a wide range (a long contact distance).

Hence, in an initial state where the applied liquid is not dried, the winding angle θ of the continuous sheet 110 with respect to the heating roller 11 decreases, and thus, the contact distance is shortened.

Here, by increasing the curvature of the heating roller 11, a tensile force generated at the time of conveying the continuous sheet 110 is changed to a pressing force in a contact portion with the heating roller 11, and thus, a contact state with respect to the heating roller 11 becomes even. In such a state, cockling or wrinkles do not occur on the continuous sheet 110, and when the continuous sheet 110 passes through the heating roller 11, heat required for evenly drying the liquid on the continuous sheet 110 can be supplied.

Accordingly, the continuous sheet 110 in which the cockling is reduced and the drying is performed, can closely contact the contact face even in a case where the contact distance with respect to the rotary body increases.

In particular, the diameter of the heating roller 11 is set to be less than or equal to 100 mm, which can reliably reduce the cockling.

Therefore, in the heating drum 12 disposed downstream from the heating roller 11, the contact distance with respect to the continuous sheet 110 increases, and thus, it is possible to supply heat to the continuous sheet 110 for a short period of time, to improve the drying efficiency, and to perform the drying for a short period of time.

The number of heating rollers 11 to contact the continuous sheet 110 increases, and a drying heat quantity increases, and thus, it is possible to increase a drying rate even in a case of a thick continuous body, and to ensure high productivity.

In the present embodiment, it is possible to set a part of the guide rollers 17C to 17I to a heating roller (a heating member). It is possible to dispose an air blower, such as a blast fan, to flow air to the continuous sheet 110, in the region of the contact heater unit 10.

Figure 4:
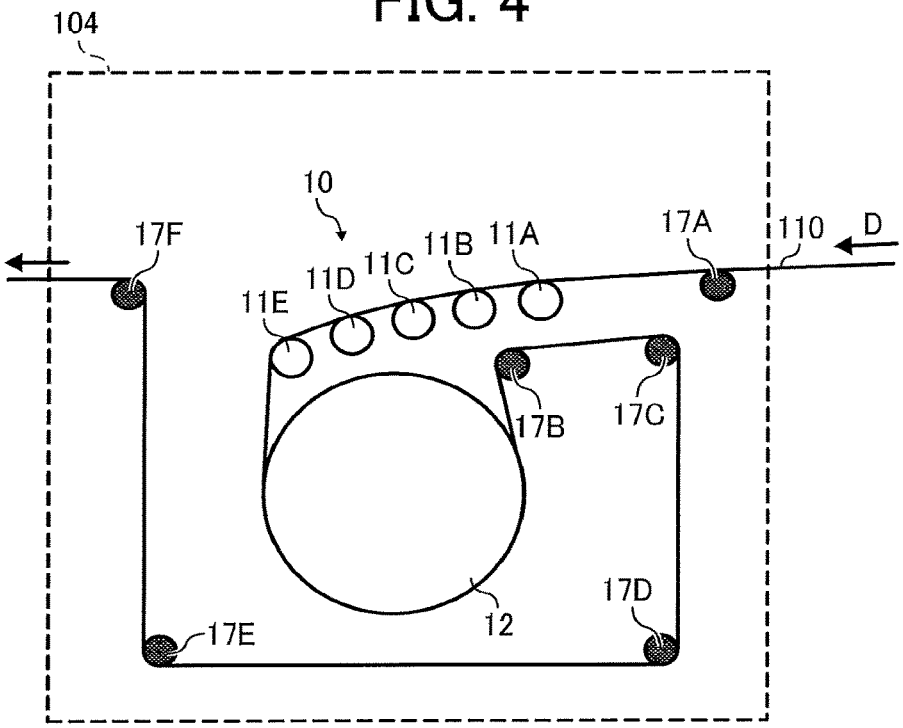
FIG. 4 is an enlarged view of a portion of the drying device of a second embodiment of the present disclosure.

Next, a second embodiment of the present disclosure is described with reference to FIG. 4. FIG. 4 is an enlarged view of a portion of a drying device according to the second embodiment.

In the present embodiment, the configuration of the printing apparatus is identical to the configuration of the first embodiment except for the drying device 104.

The drying device 104 includes five heating rollers 11 (11A to 11E) constituting the contact heater unit 10, and the heating drum 12. The drying device 104 includes the guide roller 17A disposed upstream from the contact heater unit 10, and the guide rollers 17B to 17F disposed downstream from the contact heater unit 10.

According to the arrangement of the heating roller 11E, the heating drum 12, and the guide roller 17B, a conveyance path (a conveyance route) is configured in which the continuous sheet 110 turns around the outer circumferential surface (the contact face 12*a*) of the heating drum 12.

According to such a configuration, the contact distance in which the continuous sheet 110 contacts the contact face of the heating drum 12 is longer than the contact distance of the first embodiment, thus more enhancing the drying efficiency than the drying efficiency of the first embodiment.

Figure 5:
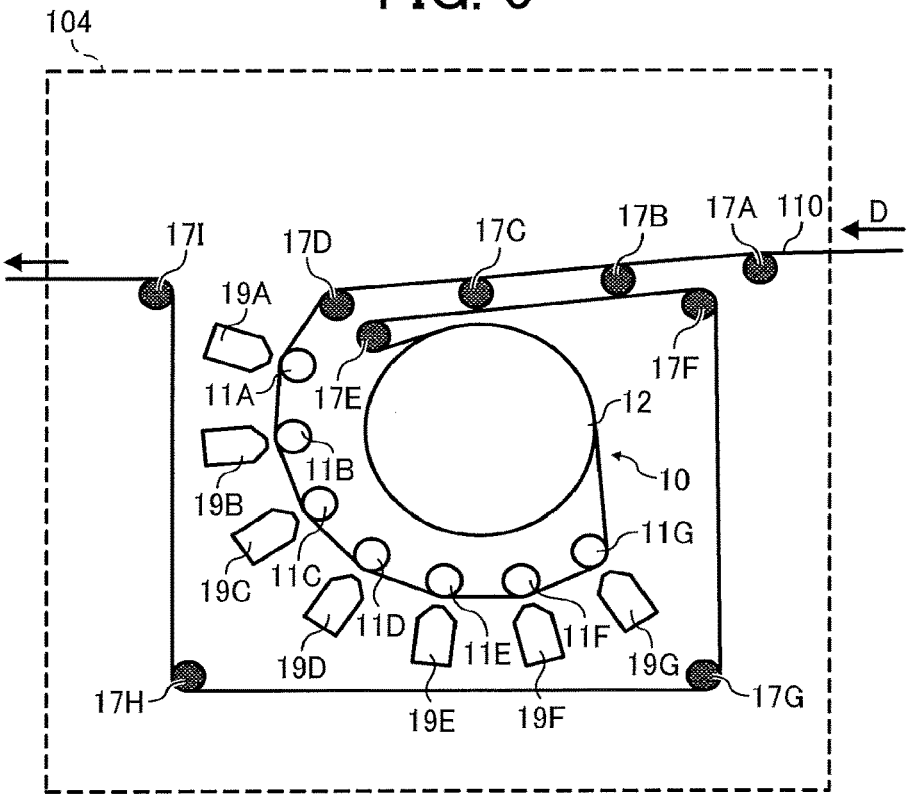
FIG. 5 is an enlarged view of a portion of the drying device according to a third embodiment of the present disclosure.

Next, a third embodiment of the present disclosure will be described with reference to FIG. 5. FIG. 5 is an enlarged view of a portion of a drying device according to the third embodiment.

In the present embodiment, the configuration of the printing apparatus is also identical to the configuration of the first embodiment except for the drying device 104.

The drying device 104 includes seven heating rollers 11 (11A to 11G) constituting the contact heater unit 10, and the heating drum 12. The drying device 104 includes guide rollers 17A to 17I.

Here, in the contact heater unit 10, seven heating rollers 11 (11A to 11G) are disposed around the heating drum 12 in a circular arc arrangement. Here, the heating rollers 11 are disposed equidistantly from the center of the heating drum 12 to the center of each of the heating rollers 11. However, the center of the heating drum 12 is not necessary to be coincident with the center of a circular arc of the heating rollers 11, which are disposed in the circular arc arrangement.

Accordingly, a load is not applied to the continuous sheet 110 when the continuous sheet 110 is conveyed in contact with the plurality of heating rollers 11, thus allowing the continuous sheet 110 to be conveyed with a suitable tensile force.

A conveyance path is configured in which the continuous sheet 110 which is guided to the contact heater unit 10 by the guide roller 17D reaches the circumferential surface of the heating drum 12 while contacting the circumferential surfaces of the heating rollers 11A to 11G on the outside (a side separated from the center side of the circular arc), and contacts the circumferential surface of the heating drum 12 in a range of an winding angle of approximately 90°, and then, is guided to a downstream side from the contact heater unit 10 by the guide roller 17E.

Accordingly, the winding angle of the continuous sheet 110 with respect to the heating drum 12 is greater than the winding angle of the continuous sheet 110 with respect to the heating roller 11, and the contact distance of the continuous sheet 110 with respect to the heating drum 12 is longer than the contact distance of the continuous sheet 110 with respect to the heating roller 11.

In the present embodiment, hot air blowers 19A to 19G as non-contact heater unit are disposed to face the heating rollers 11A to 11G.

Such a configuration can increase the number of heating rollers 11 and increase the drying rate while reducing an increase in the size of the apparatus.

Figure 6:
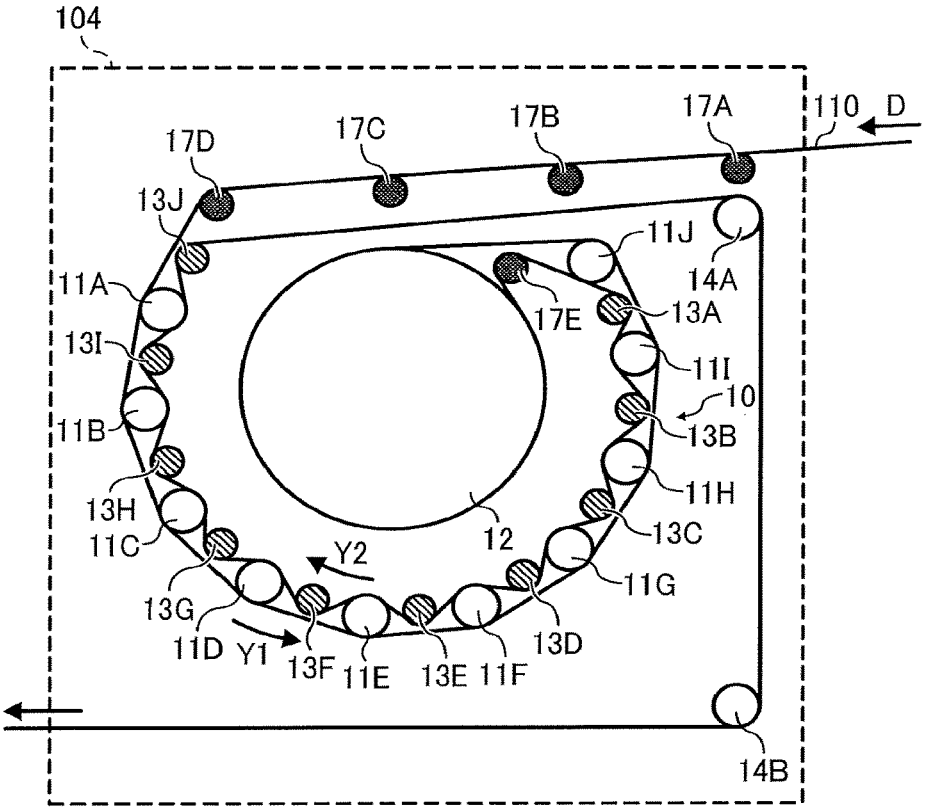
FIG. 6 is an enlarged view of a portion of the drying device according to a fourth embodiment of the present disclosure.

Next, a fourth embodiment of the present disclosure will be described with reference to FIG. 6. FIG. 6 is an enlarged view of a portion of a drying device according to the fourth embodiment.

In the present embodiment, the configuration of the printing apparatus is also identical to the configuration of the first embodiment except for the drying device 104.

The drying device 104 includes ten heating rollers 11 (11A to 11J) constituting the contact heater unit, the heating drum 12, and pressing rollers 13 (13A to 13J) to press the continuous sheet 110 against the heating rollers 11 (11A to 11J).

The drying device 104 includes the guide rollers 17A to 17D to guide the continuous sheet 110 to the contact heater unit 10, and the guide roller 17E to wind the continuous sheet 110 around the heating drum 12. The drying device 104 includes heating rollers 14A and 14B that also function as guide rollers to guide the continuous sheet 110 from the contact heater unit 10.

In the contact heater unit 10, ten heating rollers 11 (11A to 11J) are disposed around the heating drum 12 in a circular arc arrangement. Here, ten heating rollers 11 (11A to 11J) are disposed to surround the heating drum 12.

The circumferential surface of the heating roller 11 on the heating drum 12 side is referred to as an inner region, and the circumferential surface of the heating roller 11 on a side opposite to the heating drum 12 is referred to as an outer region. In this case, the heating roller 11 is rotated, and thus, a circumferential surface portion which becomes the inner region and the outer region is sequentially changed.

Here, the continuous sheet 110 that is guided to the contact heater unit 10 by the guide roller 17D is conveyed in Y1 direction, which is a first direction while contacting a portion of the outer region of the circumferential surface of the heating rollers 11A to 11J, and reaches the circumferential surface of the heating drum 12. The continuous sheet 110 contacts approximately the entire circumference of the heating drum 12, and passes through the heating drum 12, and then, is guided again to the heating roller 11J by the guide roller 17E.

The continuous sheet 110 that is guided to the heating roller 11J is pressed against a portion of the inner region of the circumferential surface of the heating rollers 11J to 11A by the pressing rollers 13A to 13J, is conveyed in Y2 direction, which is a second direction different from the first direction, in a state where the continuous sheet 110 contacts again the heating rollers 11J to 11A, and is guided to a downstream side from the contact heater unit 10.

That is, a conveyance path on which the continuous sheet 110 is conveyed while contacting the plurality of heating rollers 11A to 11J includes a first path on which the continuous sheet 110 is conveyed in the first direction (the Y1 direction) while contacting the plurality of heating rollers 11A to 11J, and a second path on which the continuous sheet 110 is conveyed in the second direction (the Y2 direction) while contacting again the plurality of heating rollers 11J to 11A that contacts the continuous sheet 110 on the first path.

Accordingly, the number of heating rollers 11 increases and the drying rate increases while an increase in the size of the apparatus is reduced, and the continuous sheet 110 simultaneously contacts the contact face (the circumferential surface) of the heating roller 11 in different positions two times, thus further improving the drying rate.

Thus, the media to be conveyed are simultaneously in contact with different two portions of the same heating member (the same heating roller) and are heated.

Accordingly, it is possible to efficiently dry the medium to be conveyed by a small heating member.

Figure 7:
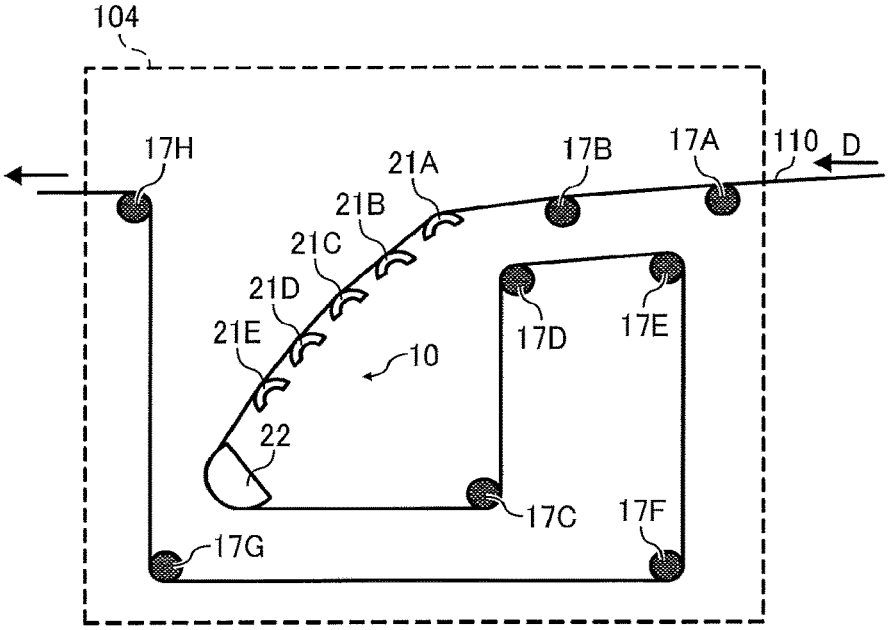
FIG. 7 is an enlarged view of a portion of the drying device according to a fifth embodiment of the present disclosure.

Next, a fifth embodiment of the present disclosure will be described with reference to FIG. 7. FIG. 7 is an enlarged view of a portion of a drying device according to the fifth embodiment.

In the present embodiment, the configuration of the printing apparatus is also identical to the configuration of the first embodiment except for the drying device 104.

The drying device 104 includes curved heating members 21 each having a curved contact face, instead of the heating roller 11 constituting the contact heater unit 10 of the first embodiment, and similarly includes a curved heating member 22 having a curved contact face instead of the heating drum 12.

According to such a configuration, it is possible to obtain the same function effect as the function effect of the first embodiment.

The present embodiment can be applied to the configuration and the arrangement of the second embodiment and the third embodiment. When the present embodiment can be applied to the configuration and the arrangement of the fourth embodiment, two curved heating members 21, which become a portion corresponding to the outer region of the circumferential surface of the heating roller 11 and a portion corresponding to the inner region of the circumferential surface of the heating roller 11, may be disposed instead of one heating roller 11.

Figure 8:
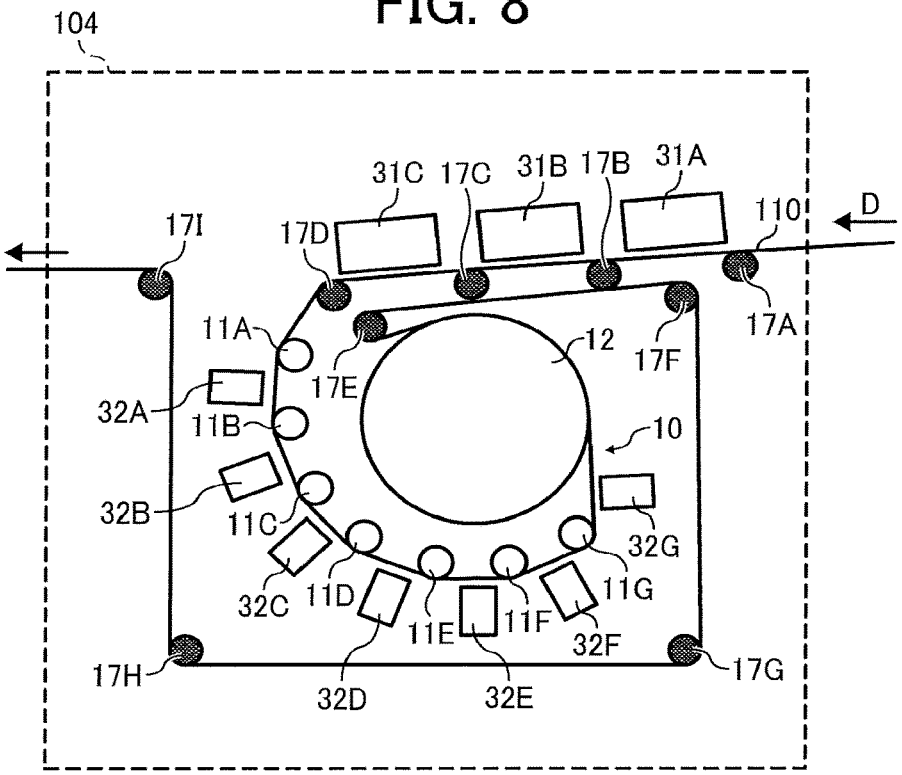
FIG. 8 is an enlarged view of a portion of the drying device according to a sixth embodiment of the present disclosure.

Next, a sixth embodiment of the present disclosure will be described with reference to FIG. 8. FIG. 8 is an enlarged view of a portion of a drying device according to the sixth embodiment.

In the present embodiment, infrared heaters 31A to 31C, which are first infrared heaters, are disposed upstream from the heating rollers 11, which are a plurality of second heating members, in an inlet portion of the drying device 104.

The infrared heater 31 irradiates the continuous sheet 110 to be conveyed with an infrared ray having a maximum wavelength in an absorption wavelength band of water. Here, the infrared heater 31 emits an infrared ray having a maximum wavelength in a band of 2 μm to 6 μm.

Accordingly, it is possible to evaporate the moisture of the liquid in the early stage.

In a region where the heating rollers 11, which are the plurality of second heating members, are disposed, infrared heaters 32A to 32G, which are second infrared heaters, to emit an infrared ray having a maximum wavelength in an absorption wavelength band of a solvent contained in the liquid, are disposed. Here, the infrared heater 32 emits an infrared ray having a maximum wavelength in a band of 3 μm to 8 μm.

Accordingly, it is possible to evaporate the solvent of the liquid.

Here, the infrared heaters 32A to 32F, which are the second infrared heaters are disposed between the respective heating rollers 11, which are the adjacent second heaters, and the infrared heaters 32A to 32G are disposed between the heating roller 11G and the heating drum 12.

Thus, the infrared heater is disposed between the adjacent contact type heating members, and thus, it is possible to obtain an effect of maintaining a temperature rising effect of a continuous sheet.

Figure 9:
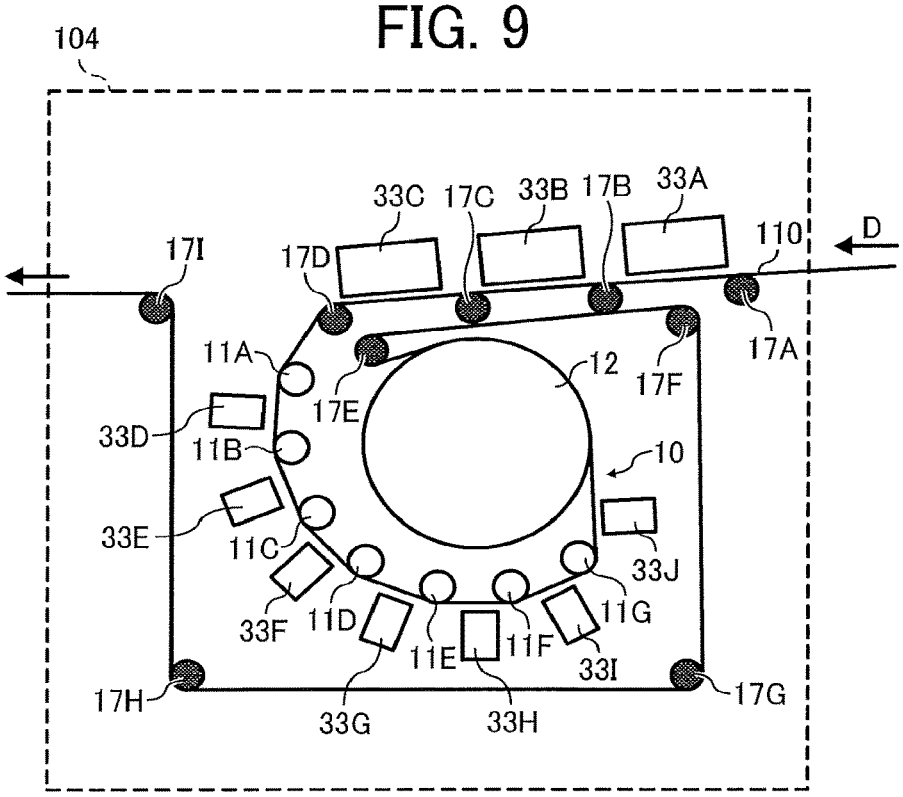
FIG. 9 is an enlarged view of a portion of the drying device according to a seventh embodiment of the present disclosure.
Figure 10:
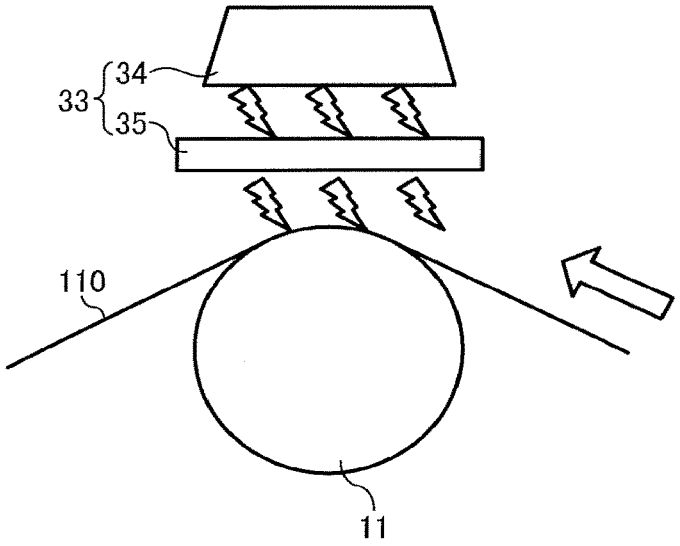
FIG. 10 is an illustration of an example of an infrared heater of the drying device according to the seventh embodiment.

Next, a seventh embodiment of the present disclosure will be described with reference to FIGS. 9 and 10. FIG. 9 is an enlarged view of a portion of a drying device according to the seventh embodiment, and FIG. 10 is an illustration of an example of an infrared heater of the drying device.

In the present embodiment, third infrared heaters 33 (33A to 33J) are respectively disposed upstream from the heating rollers 11, which are the plurality of second heating members, and in a region where the heating rollers 11, which are the plurality of second heating members, are disposed (including a space between the heating roller 11 and the heating drum 12), in the inlet portion of the drying device 104.

The third infrared heater 33 emits an infrared ray having a maximum wavelength in the absorption wavelength band of the solvent contained in the liquid except for a maximum wavelength at which water absorbs an infrared ray. Here, the third infrared heater 33 emits an infrared ray having a maximum wavelength in the absorption wavelength band of the solvent except for maximum wavelengths of 2 μm, 3 μm, and 6 μm at which water absorbs an infrared ray.

That is, in a case where a medium such as a continuous sheet having weak stiffness is used, and the medium is irradiated with an infrared ray that evaporates a solvent component in order to dry the liquid containing the solvent, an infrared ray absorption band of water is also included in the infrared ray, and thus, the moisture that is contained in the medium is also heated. For this reason, contraction occurs in a portion of the medium to which the liquid is not applied (a blank sheet portion), and the cockling occurs.

Therefore, in the present embodiment, the solvent component of a portion to which the liquid is applied (a printing portion) is evaporated in a state of suppressing the heating of the moisture in the medium, and the printing portion is heated, and thus, it is possible to prevent the occurrence of the cockling with respect to the medium having weak stiffness.

Here, in order to emit an infrared ray having a specific wavelength, for example, as illustrated in FIG. 10, an infrared ray exiting from an infrared heater 34, which is the infrared ray irradiator, passes through an infrared ray filter 35 blocking a specific wavelength, and thus, it is possible to remove the infrared ray having a specific wavelength.

Specifically, infrared rays of 2 μm, 3 μm, and 6 μm are cut by the infrared ray filter 35, and the continuous sheet 110 is irradiated with the other infrared ray.

The infrared heater is capable of including an infrared ray irradiator that generates an infrared ray having a wavelength in a specific band.

Figure 11:
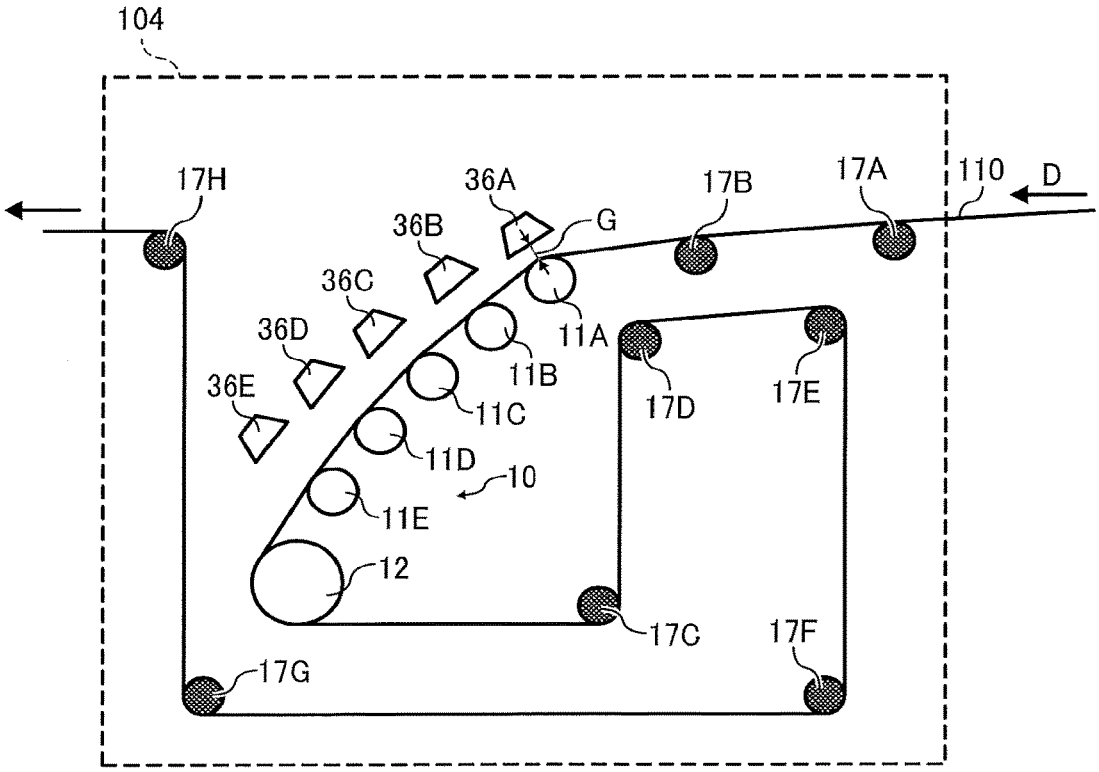
FIG. 11 is an enlarged view of a portion of the drying device according to an eighth embodiment of the present disclosure.

Next, an eighth embodiment of the present disclosure will be described with reference to FIG. 11. FIG. 11 is an enlarged view of a portion of a drying device according to the eighth embodiment.

For the present embodiment, in the first embodiment (or the second embodiment to the fifth embodiment), radiation heaters 36A to 36E including an infrared ray lamp, a halogen lamp, and the like, are disposed to face the portions of the heating rollers 11. As with the sixth embodiment, the radiation heaters 36A to 36E can be disposed to face a space between the heating rollers 11.

Here, in two adjacent radiation heaters 36 in the conveyance direction D, a gap G between the radiation heater 36 on a downstream side and the continuous sheet 110 (the heating roller 11) is wider than a gap G between the radiation heater 36 on an upstream side and the continuous sheet 110 (the heating roller 11).

Specifically, the radiation heaters 36A to 36E are disposed such that the gap G sequentially widens from the radiation heater 36A on the most upstream side towards the radiation heater 36E on a downstream side. In a case where heat quantities are set to be the same, the heat quantity that is imparted to the continuous sheet 110 decreases as the gap G widens.

Accordingly, it is possible to change the heat quantity according to the degree of permeation of the liquid with respect to the continuous sheet 110 in a state where the heat quantities of a plurality of radiation heaters 36 are set to be the same.

Figure 12:
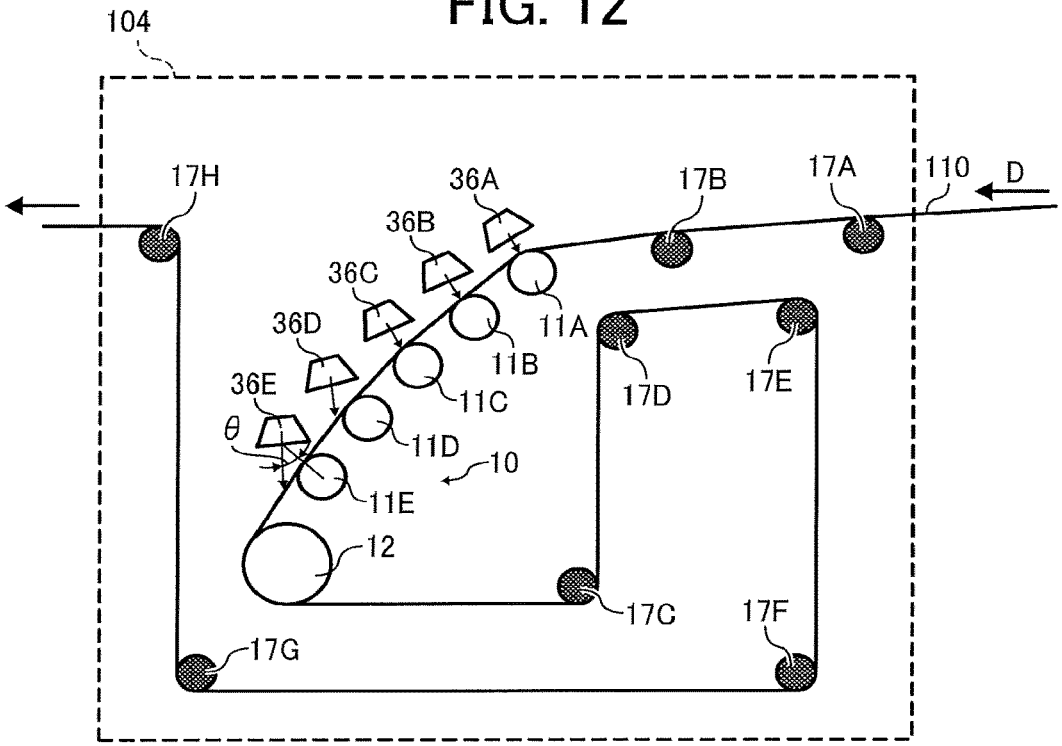
FIG. 12 is an enlarged view of a portion of the drying device according to a ninth embodiment of the present disclosure.

Next, a ninth embodiment of the present disclosure will be described with reference to FIG. 12. FIG. 12 is an enlarged view of a portion of a drying device according to the ninth embodiment.

For the present embodiment, in the first embodiment (or the second embodiment to the fifth embodiment), the radiation heaters 36A to 36E are disposed to face the portions of the heating rollers 11. As with the sixth embodiment, the radiation heaters 36A to 36E can be disposed to face a space between the heating rollers 11.

Here, in two adjacent radiation heaters 36 in the conveyance direction D, an inclination θ of the radiation heater 36 on a downstream side with respect to the continuous sheet 110 in a radiation direction is greater than an inclination θ of the radiation heater 36 on an upstream side with respect to the continuous sheet 110 in the radiation direction. The inclination θ is an inclination of an energy emission surface of the radiation heater 36 with respect to a perpendicular line of a front surface of the continuous sheet 110, and increasing the inclination θ indicates that the energy emission surface does not face the continuous sheet 110.

Specifically, the radiation heaters 36A to 36E are disposed such that the inclination θ in the radiation direction sequentially increases from the radiation heater 36A on the most upstream side towards the radiation heater 36E on a downstream side. When the heat quantities are set to be the same, the heat quantity that is imparted to the continuous sheet 110 decreases as the inclination θ increases.

Accordingly, it is possible to change the heat quantity according to the degree of permeation of the liquid with respect to the continuous sheet 110 in a state where the heat quantities of a plurality of radiation heaters 36 are set to be the same.

Figure 13:
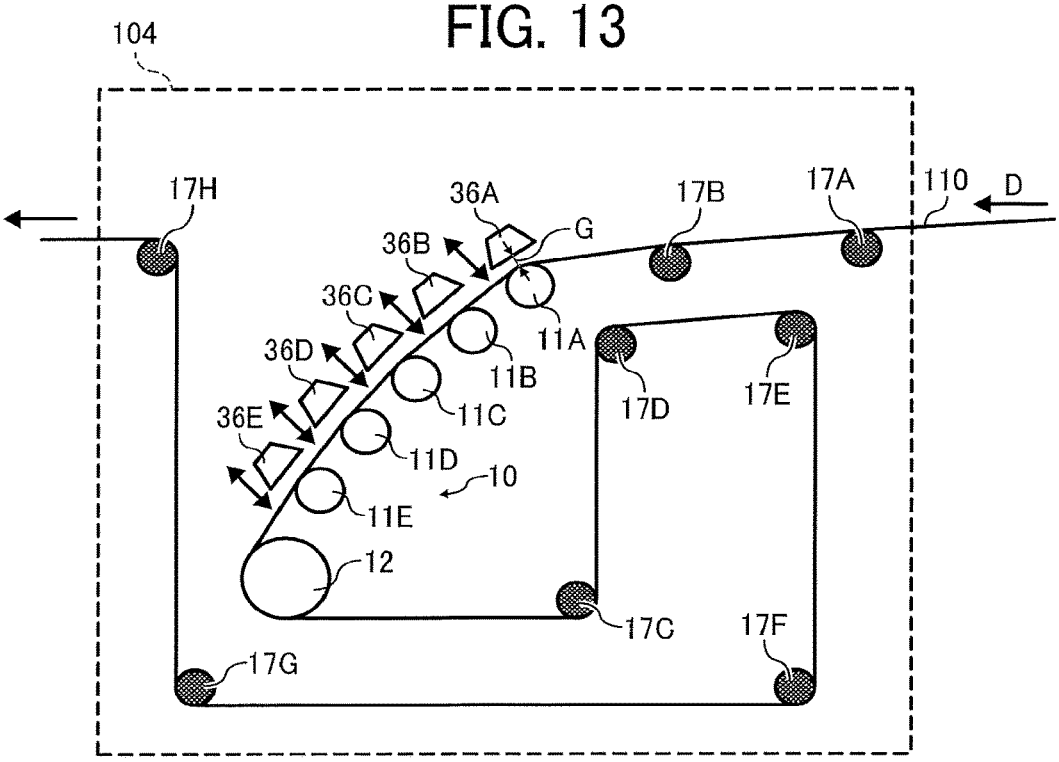
FIG. 13 is an enlarged view of a portion of the drying device according to a tenth embodiment of the present disclosure.

Next, a tenth embodiment of the present disclosure will be described with reference to FIG. 13. FIG. 13 is an enlarged view of a portion of a drying device according to the tenth embodiment.

In the present embodiment, the plurality of radiation heaters 36 are movably (retractably) disposed with respect to the continuous sheet 110 in an arrow direction, and thus, are capable of changing the gap G.

Accordingly, the position of each of the radiation heaters 36 is changed, and thus, it is possible to change the heat quantity that is imparted to the continuous sheet 110, and to dispose the radiation heaters 36 such that the gap G is changed as with the eighth embodiment.

In this case, the plurality of radiation heaters 36 are swingably disposed, and thus, it is possible to change the inclination with respect to the continuous sheet 110 in the radiation direction as with the ninth embodiment.

Figure 14:
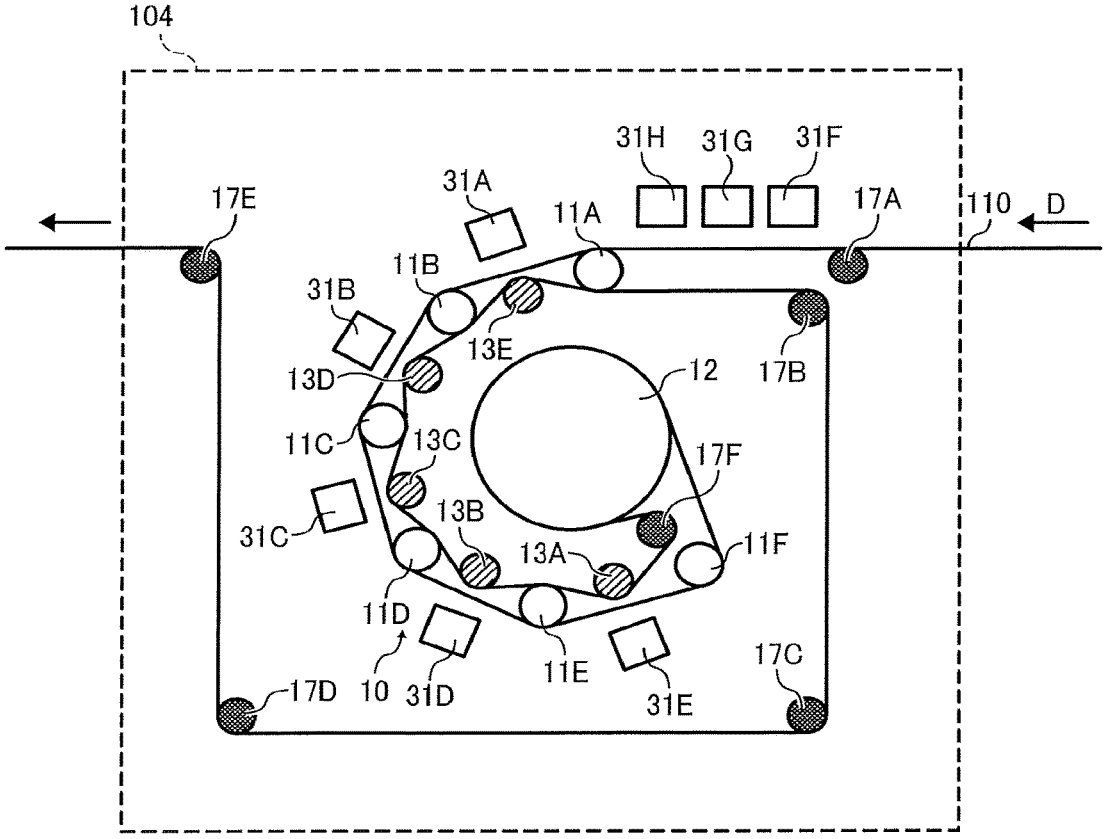
FIG. 14 is an enlarged view of a portion of the drying device according to an eleventh embodiment of the present disclosure.

Next, an eleventh embodiment of the present disclosure will be described with reference to FIG. 14. FIG. 14 is an enlarged view of a portion of a drying device according to the eleventh embodiment.

The drying device 104 includes six heating rollers 11 (11A to 11F) constituting the contact heater unit 10, the heating drum 12, and the pressing rollers 13 (13A to 13E) to press the continuous sheet 110 against the heating rollers 11 (11A to 11F).

The drying device 104 includes the guide roller 17A to guide the continuous sheet 110 to the heating roller 11A, the guide roller 17F to wind the continuous sheet 110 around the heating drum 12, and the guide rollers 17B to 17E to guide the drawn-out continuous sheet 110 in contact with the heating roller 11A at the second time.

In the present embodiment, as with the fourth embodiment, a conveyance path on which the continuous sheet 110 is conveyed while contacting the plurality of heating rollers 11A to 11F includes a first path on which the continuous sheet 110 is conveyed while contacting the plurality of heating rollers 11A to 11F, and a second path on which the continuous sheet 110 is guided to the plurality of heating rollers 11J to 11F that contacts the continuous sheet 110 on the first path, by the pressing rollers 13A to 13E, and is conveyed in the second direction while contacting again the plurality of heating rollers 11J to 11F.

In the present embodiment, infrared heaters 31A to 31E, which are the first infrared heaters, are disposed between the heating rollers 11 and 11. Infrared heaters 31F to 31H, which are the first infrared heaters, are also disposed upstream from the infrared heater 31A.

As described above, the infrared heater 31 irradiates the continuous sheet 110 to be conveyed with an infrared ray having a maximum wavelength in the absorption wavelength band of water. Here, the infrared heater 31 emits an infrared ray having a maximum wavelength in a band of 2 μm to 6 μm.

Figure 15:
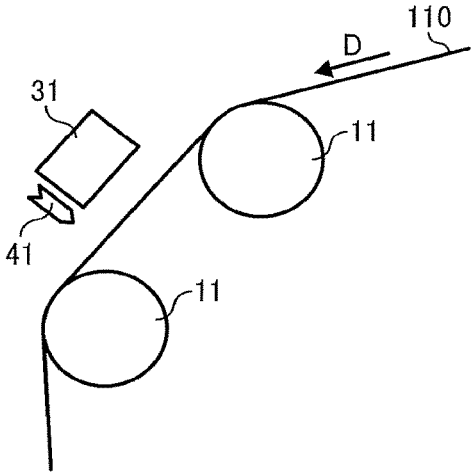
FIG. 15 is an illustration of arrangement of a temperature sensor in the eleventh embodiment.
Figure 16:
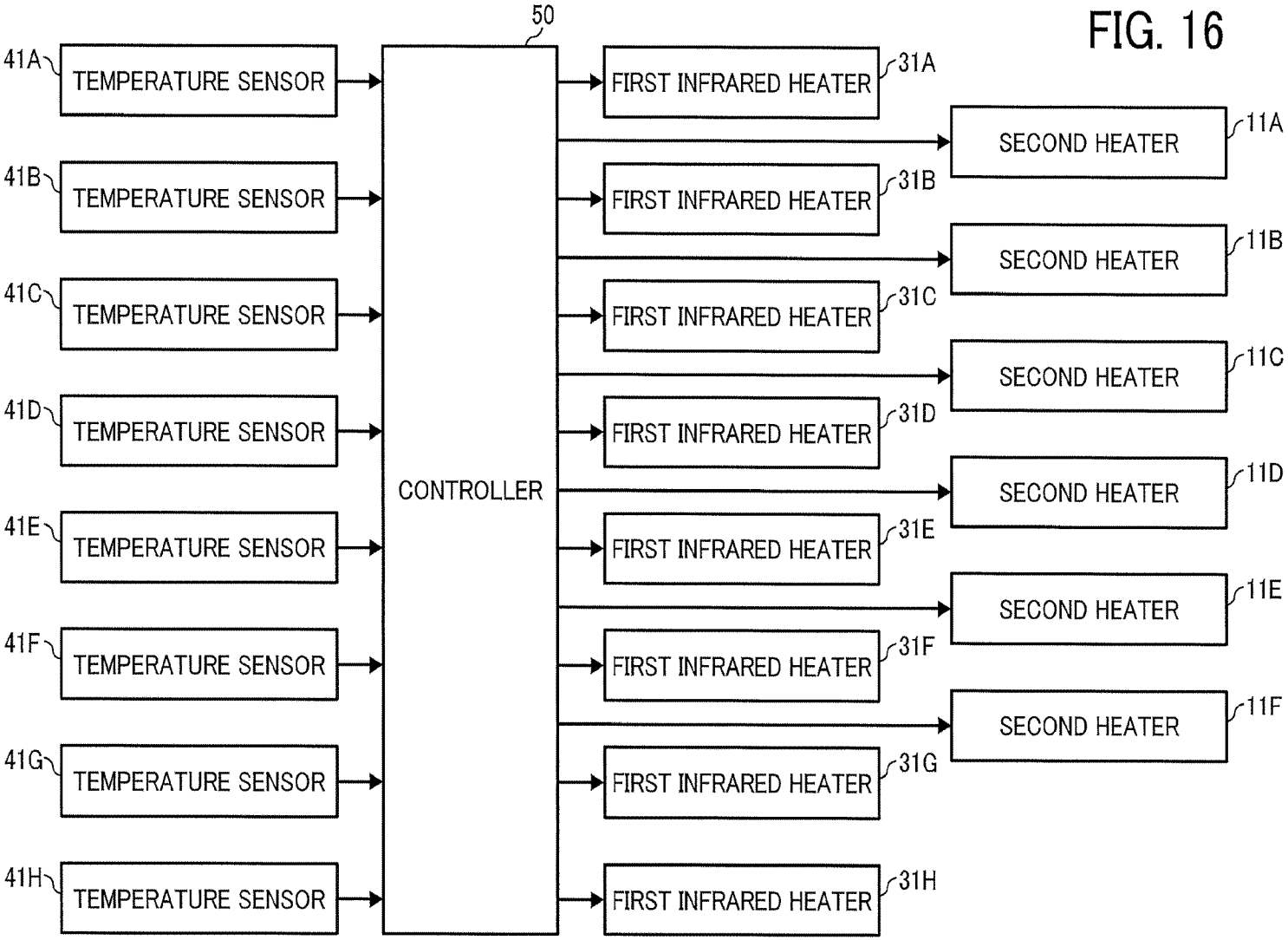
FIG. 16 is a block diagram of a portion relevant to temperature control of a first infrared heater and a second heating member in the eleventh embodiment.

Next, the temperature control of the first infrared heater and the second heating member of the present embodiment will be described with reference to FIGS. 15 and 16. FIG. 15 is an illustration of the arrangement of a temperature sensor, and FIG. 16 is a block diagram of a portion relevant to the temperature control of the first infrared heater and the second heater.

Temperature sensors 41 (41A to 41E), which are temperature detectors, sensing the temperature of the continuous sheet 110 are disposed downstream from the infrared heaters 31, which are the first infrared heaters. In FIG. 16, the infrared heater 31 is represented as the "first infrared heater".

A sensing signal of each of the temperature sensors 41 corresponding to a downstream portion of each of the infrared heaters 31 is input into a controller 50. The controller 50 controls the wavelength of the infrared ray emitted from each of the infrared heaters 31 and the temperature of each of the heating rollers 11 according to the sensed temperature that is obtained from the sensing signal of the temperature sensor 41. The temperature of any one of the infrared heater 31 and the heating roller 11 may be controlled.

In the infrared heater 31, an input voltage (an application voltage) decreases, and thus, the temperature of a heat source decreases, and a maximum wavelength of an infrared ray to be emitted increases.

In order to evaporate the liquid, the temperature is preferably raised as possible as to increase a vapor pressure of the liquid. However, there is a concern that a damage such as blister and yellowing occurs on the member onto which the liquid is applied in a case of excessively increasing the temperature, and thus, it is necessary to control the temperature in a suitable temperature range.

Therefore, for example, in order to control the temperature of the continuous sheet 110, which is the member onto which the liquid is applied, such that the temperature is 100° C. to 150° C., when sensed temperature of the continuous sheet 110 which is sensed by the temperature sensor 41 on a downstream side from the infrared heater 31 is lower than or equal to 100° C., the controller 50 performs control of increasing the application power such that an infrared ray having a maximum wavelength of 2 μm is emitted, and increases the application power with respect to the heating roller 11 and the temperature.

When the sensed temperature is higher than or equal to 150° C., for example, in order to increase the maximum wavelength of the infrared heater, control of decreasing the application power is performed such that an infrared ray having a maximum wavelength of 3 μm to 8 μm is emitted, and decreases the application power with respect to the heating roller 11 and the temperature.

That is, the controller 50 controls the application voltage with respect to the infrared heater 32 such that the sensed temperature of the continuous sheet 110 that is sensed by the temperature sensor 41 on a downstream side from the infrared heater 31 is 100° C. to 150° C.

Thus, the application power with respect to the first infrared heater and the second heating member is controlled, and thus, it is possible to rapidly control the temperature of the member onto which the liquid is applied. Therefore, it is possible to increase a conveyance rate of the medium to be conveyed, and to improve the productivity.

Here, an example has been described in which a heating temperature of the first infrared heater and the second heating member is controlled, but the heating temperature of at least any one of the first infrared heater and the second heating member can be controlled. Similarly, in the configuration of disposing the second infrared heater, the heating temperature of at least any one of the second infrared heater and the second heating member can be controlled.

Figure 17:
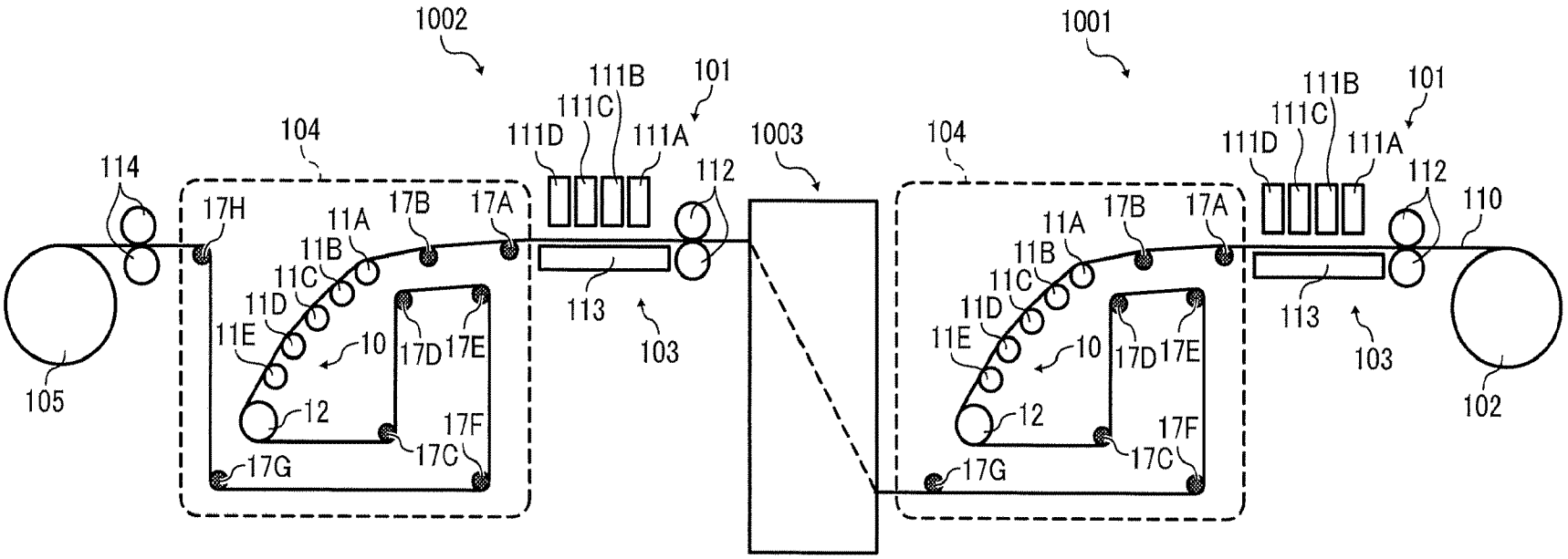
FIG. 17 is a schematic view of a printing apparatus according to a twelfth embodiment of the present disclosure.

Next, a printing apparatus according to a twelfth embodiment of the present disclosure will be described with reference to FIG. 17. FIG. 17 is a schematic view of the printing apparatus.

In the printing apparatus, a first printing unit 1001 that performs printing and drying with respect to one surface of the continuous sheet 110, a reversing unit 1003 that reverses both surfaces of the continuous sheet 110 of which one surface is printed by the first printing unit 1001, and a second printing unit 1002 that performs printing and drying with respect to the other surface of the continuous sheet 110 are disposed between the feeding roller 102 and the winding roller 105.

The configuration of the liquid application unit 101, the conveyance unit 103, and the drying device 104 of the first printing unit 1001 and the second printing unit 1002 is approximately identical to (may be identical to) the configuration of the first embodiment, and can be identical to or approximately identical to the configuration of the second embodiment to the eleventh embodiment.

Here, the liquid application unit 101 of the first printing unit 1001 is a first liquid applicator applying the liquid onto a first surface of the continuous sheet 110, which is the medium to be conveyed. The liquid application unit 101 of the second printing unit 1002 is a second liquid applicator applying the liquid onto a second surface of the continuous sheet 110, which is the medium to be conveyed, on a side opposite to the first surface.

The drying device 104 of the first printing unit 1001 is a first drying device in which the second surface of the continuous sheet 110 contacts the heating roller 11. The drying device 104 of the second printing unit 1002 is a second drying device in which the first surface of the continuous sheet 110 contacts the heating roller 11.

In each of the above-described embodiments, the term "medium" represents a medium or member to be conveyed by the drying device. In the above descriptions, an example has been described in which the medium to be conveyed is a continuous sheet. However, the medium to be conveyed is not limited to the continuous sheet. For example, a printed object, such as a sheet for an electronic circuit board, for example, wallpaper, prepreg, and the like, may be used in addition to a continuous body, such as a continuous sheet, a roll sheet, and a web, and a recording medium (a printed object) such as an elongated sheet material.

Not only is an image such as characters or figures recorded on the member that is conveyed by the printing apparatus by a liquid such as ink, but also a meaningless image such as a pattern may be applied onto the member by a liquid such as ink in order for decoration or the like.

Herein, the liquid to be applied is not particularly limited, but it is preferable that the liquid has a viscosity of less than or equal to 30 mPa·s under a normal temperature and a normal pressure or by being heated or cooled. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

When a liquid discharge head is used as the liquid applicator, examples of an energy generation source discharging a liquid include an energy generation source using a piezoelectric actuator (a lamination-type piezoelectric element and a thin-film piezoelectric element), a thermal actuator using an electrothermal transducer element such as a heating resistor, a static actuator including a diaphragm plate and opposed electrodes, and the like.

Herein, the printing has the same meaning as the meaning of image formation, recording, printing, imprinting, and the like.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A drying device comprising:

a contact heater to contact and heat a medium, the contact heater including a plurality of heaters each having a curved contact face to contact the medium, the plurality of heaters including:

a first heater having a maximum contact distance to contact the medium among plural heaters of the plurality of heaters to contact a first surface of the medium opposite a second surface of the medium on which liquid is applied; and a plurality of second heaters, wherein a contact length of each of the plurality of second heaters with the medium is smaller than a contact length of the first heater with the medium, and the plurality of second heaters contacts the first surface of the medium, and the drying device further comprises a path on which the first heater contacts and heats the first surface of the medium after at least two heaters of the plurality of second heaters contact and heat the first surface of the medium.

2. The drying device according to claim 1, wherein the plurality of heaters are rollers, wherein a diameter of the first heater is greater than a diameter of each of the plurality of second heaters.

3. The drying device according to claim 1, wherein the plurality of second heaters and the first heater are disposed in an arcuate arrangement.

4. The drying device according to claim 1, wherein the plurality of second heaters are disposed to surround the first heater.

5. The drying device according to claim 1, wherein the plurality of second heaters are disposed around the first heater in an arcuate arrangement or a circular arc arrangement.

6. The drying device according to claim 1, further comprising a non-contact heater to heat the medium in a non-contact manner.

7. The drying device according to claim 1, wherein a conveyance path on which the medium is conveyed while contacting the plurality of second heaters includes:

a first path on which the medium is conveyed while contacting the plurality of second heaters; and a second path on which the medium is conveyed while contacting again at least one of the plurality of second heaters that contacts the medium on the first path.

8. The drying device according to claim 1, further comprising an infrared heater disposed upstream from the plurality of second heaters in a direction of conveyance of the medium, to irradiate the medium with an infrared ray having a maximum wavelength in an absorption wavelength band of water.

9. The drying device according to claim 1, further comprising:

an infrared heater to irradiate the medium with an infrared ray having a maximum wavelength in an absorption wavelength hand of water;

a temperature detector to detect a temperature of a surface of the medium; and a controller to control a heating temperature of at least one of the infrared heater and the plurality of second heaters according to the temperature detected with the temperature detector.

10. The drying device according to claim 1, further comprising an infrared heater disposed in a region in which the plurality of second heaters is disposed, to emit an infrared ray having a maximum wavelength in an absorption wavelength band of a solvent contained in the liquid.

11. The drying device according to claim 10, wherein the infrared heater emits an infrared ray having a maximum wavelength in a hand of 3 μm to 8 μm.

12. The drying device according to claim 10, wherein the infrared heater is disposed between adjacent second heaters of the plurality of second heaters.

13. The drying device according to claim 1, further comprising:

an infrared heater to irradiate the medium with an infrared ray, wherein the infrared heater emits an infrared ray having a maximum wavelength in an absorption wavelength band of a solvent contained in the liquid, except for a maximum wavelength at which water absorbs an infrared ray.

14. The drying device according to claim 13, wherein the infrared heater includes:

an infrared ray irradiator to emit infrared rays; and a filter to absorb a component of a maximum wavelength at which water absorbs an infrared ray, among the infrared rays emitted from the infrared ray irradiator.

15. The drying device according to claim 1, further comprising at least two radiation heaters arranged along a direction of conveyance of the medium, to heat the medium, wherein the at least two radiation heaters are disposed to have different gaps with respect to the medium.

16. The drying device according, to claim 15, wherein a gap between a downstream radiation heater of the at least two radiation heaters in the direction of conveyance of the medium and the medium is greater than a gap between an upstream radiation heater of the at least two radiation heaters in the direction of conveyance of the medium and the medium.

17. The drying device according to claim 1, further comprising at least two radiation heaters arranged along a direction of conveyance of the medium, to heat the medium, an inclination of a downstream radiation heater of the at least two radiation heaters in the direction of conveyance of the medium with respect to the medium in a radiation direction is greater than an inclination of an upstream radiation heater of the at least two radiation heaters in the direction of conveyance of the medium with respect to the medium in the radiation direction.

18. The drying device according to claim 1, further comprising a radiation heater arranged along a direction of conveyance of the medium, to heat the medium, wherein the radiation heater is changeable in a gap with respect to the medium or an inclination with respect to the medium in a radiation direction.

19. A printing apparatus comprising:

a liquid applicator to apply liquid onto the medium; and the drying device according to claim 1 to dry the medium on which the liquid is applied.

20. A printing apparatus comprising:

a first liquid applicator to apply liquid onto a first surface of a medium;

a first drying device constituted of the drying device according to claim 1, the first drying device disposed downstream from the first liquid applicator in a direction of conveyance of the medium;

a second liquid applicator to apply liquid onto the second surface of the medium, which is opposite to the first surface of the medium, the second liquid applicator disposed downstream from the first drying device in the direction of conveyance of the medium; and a second drying device constituted of the drying device according to claim 1, the second drying device disposed downstream from the second liquid applicator in the direction of conveyance of the medium.

* * * * *